US006279657B1

(12) United States Patent
Carmichael et al.

(10) Patent No.: US 6,279,657 B1
(45) Date of Patent: Aug. 28, 2001

(54) APPARATUS AND METHOD FOR CIRCULATING FLUID IN A WELL BORE

(75) Inventors: Mark Carmichael, Aberdeenshire; Paul Howlett, Aberdeen, both of (GB)

(73) Assignee: Specialised Petroleum Services Limited, Aberdeenshire (GB)

( * ) Notice: Subject to any disclaimer, the term of this patent is extended or adjusted under 35 U.S.C. 154(b) by 0 days.

(21) Appl. No.: 09/173,258

(22) Filed: Oct. 14, 1998

(30) Foreign Application Priority Data

Oct. 15, 1997 (IO) ..... 9721730

(51) Int. Cl.[7] ..... E21B 21/12
(52) U.S. Cl. ..... 166/311; 166/334.1; 166/331
(58) Field of Search ..... 166/331, 333.1, 166/334.1, 222, 311, 373, 237, 117.7, 330, 382, 214, 312; 175/317, 322, 235, 321, 106

(56) References Cited

U.S. PATENT DOCUMENTS 3,901,333 * 8/1975 Mori ..... 166/334.3 X
3,907,046 * 9/1975 Gaylord ..... 175/317 X
4,657,082 * 4/1987 Renggenberg ..... 166/331 X
5,275,241 * 1/1994 Vigor et al. ..... 166/373

* cited by examiner

*Primary Examiner*—William Neuder
(74) *Attorney, Agent, or Firm*—Clifford W. Browning; Woodard, Emhardt, Naughton, Moriarty & McNett

(57) ABSTRACT

A circulating tool for circulating fluid in a borehole comprising a tubular assembly having an axial through passage between an inlet and a first outlet, a second outlet extending generally transversely of the tubular assembly, and an obturating member moveable relative to the tubular assembly between a first position closing the second outlet and a second position at which the second outlet is open, wherein the obturating member is also moveable between an engaging position at which it is engaged with the tubular assembly and a non-engaging position at which it is not so engaged with the tubular assembly, and wherein when the obturating member is in the first position it may be in either the engaging position or the non-engaging position.

8 Claims, 2 Drawing Sheets

APPARATUS AND METHOD FOR CIRCULATING FLUID IN A WELL BORE

This invention relates to apparatus and method for circulating fluid and, in particular, apparatus for circulating fluid in a casing or liner installed in a well borehole. The circulation of fluid may typically be required to clean the casing or other tubing from debris, shavings, oxidation lumps, burrs and the like.

BACKGROUND OF THE INVENTION

It is known to carry out this operation by employing a tool connected in a drill-string and positioned substantially in the vicinity of the top of the liner. The tools known to the art provide a means for circulating fluid through the length of a drill string to the lower end of the liner and which can also redirect the cleaning fluid at higher flow rates out of the drill string into the casing above the liner.

Such tools have been made of at least two generic types. The more common of these utilises the well known practice of dropping spherical balls or darts down the drill string to open or close valves, thereby alternating the circulation path of the fluid. There are a number of disadvantages associated with this type of circulation tool, including the length of time taken for the balls to fall from the surface to the tool which renders it difficult to co-ordinate the arrival of the ball in its required position with the arrival of the cleaning fluid. The alternate flow rates of the fluid relative to the casing and liner clean out must also be so co-ordinated.

Yet further, it is usually necessary to repeat the cleaning out of the liner and casing a number of times with different cleaning fluids. In order to do this there must be a sufficient number of spherical balls and associated valves and ports to redirect the clean-out liquid flow on each occasion either from the lower end of the liner to the upper end or from the upper end to the lower end.

Yet further, it is possible for the balls or darts not to engage at their targeted location, causing malfunction.

The second type of circulation tool is a weight set tool, an example of which is described in our earlier British Patent Number 2 272 923. This type of circulation tool dispenses with the need for drop balls or darts and allows for an unlimited number of recirculation stages. The tool permits circulation fluids to separate regions in a borehole by increasing or decreasing the load exerted on at least part of the tool in the borehole. This also enables redirection of the circulation flow without any significant time delay.

With this second type of circulation tool, a tubular assembly is connected to the drill string and is provided with a generally axial fluid outlet and a generally transverse fluid outlet, and an obturating member which is moveable between a first position closing the transverse fluid outlet and a second position at which the transverse fluid outlet is open. The obturating member is moved relative to the tubular assembly by extending or collapsing the tool, the latter movement occurring by causing a shoulder coupled to the obturating member to engage with a formation in the borehole.

Typically, when the tool is in the extended position the obturating member or an extension thereof is keyed or otherwise engaged with the tubular assembly so that torque applied through the tubular assembly is transmitted to the obturating member. That is to say there is negligible relative rotational movement between the tubular assembly and the obturating member when the tool is in the extended position, thereby allowing the tool to function in a manner such that apparatus below the tool may be rotated.

On the other hand, when the tool is in the collapsed position, typically with the generally transverse outlet open, the obturating member is disengaged from the tubular assembly allowing for relative rotation between the two components. While the obturating member is so disengaged, torque can not be transmitted down the drill string beyond the circulation tool.

Thus, in the past it has been necessary with such weight set circulation tools to mutually engage a mating portion such as a key or spline of the obturating member or an extension thereof with a corresponding mating portion of the tubular assembly in order to close the generally transverse outlet.

A disadvantage of this design in that on some occasions the respective mating portions may fail to properly engage, preventing the full extension of the tool and leaving the transverse outlets from undesirably. Where this occurs the drilling apparatus is disenabled and it is necessary to remove the entire drill string from the borehole, lending to substantial downtime and associated cost.

SUMMARY OF THE INVENTION

An object of the present invention is to provide an improved weight set circulation tool whereby the design of the tool obviates or at least mitigates the above mentioned disadvantage.

According to a first aspect of the present invention there is provided a circulation tool for circulating fluid in a borehole comprising a tubular assembly having an axial through passage between an inlet and a first outlet, a second outlet extending generally transversely of the tubular assembly, and an obturating member moveable relative to the tubular assembly between a first position closing the second outlet and a second position at which the second outlet is open, wherein the obturating member is also moveable between an engaging position at which it is engaged with the tubular assembly and a non-engaging position at which it is not so engaged with the tubular assembly, and wherein when the obturating member is in the said first position it may be in either the said engaging position or the said non-engaging position.

Typically when the obturating member is in the engaging position torque imparted to the tubular assembly is transmitted to the obturating member and when the obturating member is in the non-engaging position torque imparted to the tubular assembly is not transmitted to the obturating member. In another example embodiment, the obturating member may be in the engaging position when it or an extension thereof engages with the tubular assembly or an extension thereof to prevent further extension of the tool.

Preferably the obturating member comprises a piston and a mandrel and is provided with a mating portion which engages when the obturating member is in the engaging position with a corresponding mating portion provided on the tubular assembly.

The mating portions may comprise of a key and slot or splines and grooves. Alternatively, the obturating member may have a cornered profile at its mating portion corresponding to a similar shaped mating portion on the tubular assembly, one mating portion being male and the other female. The cornered profile may be hexagonal, for example.

According to a second aspect of the invention there is provided a circulation tool for circulating fluid in a borehole comprising a tubular assembly having an axial through passage between an inlet and a first outlet, a second outlet extending generally transversely of the tubular assembly, and an obturating member moveable relative to the tubular assembly between a first position closing the second outlet and a second position at which the second outlet is open, wherein the obturating member is associated with a mating portion for engaging with a corresponding mating portion associated with the tubular assembly, wherein the obturating member is also moveable between an engaging position at which the respective mating portions are engaged and an non-engaging position at which the respective mating portions are not so engaged, and wherein guide means is provided for guiding the respective mating portions into an engaged relationship as the obturating member moves toward the said engaging position.

The guide means may be a shaped profile on the obturating member and the tubular assembly which interact to align the respective mating portions as the obturating member moves toward the said engaging position.

According to a further aspect of the present invention there is provided a method of cleaning a borehole comprising the steps of:

a) connecting a circulation tool in a drill string suspended in the borehole, the circulation tool having a tubular assembly and an obturating member axially movable relative thereto by a predetermined distance or stroke, the tubular assembly also having one or more generally transverse fluid outlets which allows fluid flow therethrough when the one or more generally transverse outlet are open;

b) causing sufficient movement of the obturating member to close or obstruct the transverse one or more fluid outlets, wherein the said sufficient movement is less than the said predetermined distance or stroke; and c) allowing additional movement of the obturating member relative to the tubular assembly to cause engagement of a mating portion on the obturating member with a corresponding mating portion on the tubular assembly.

In the first of the above mentioned steps, the weight or a percentage thereof of the drill string may be supported on a formation in the borehole, and in the second and third of the above mentioned steps the weight or a percentage thereof of the drill string may be picked up.

Preferably rotational guidance is provided during the said additional movement to guide the corresponding mating portions into mutual engagement.

In order to provide a better understanding of the invention, an embodiment will now be described, by way of example only, with reference to the following Figures.

DETAILED DESCRIPTION OF THE PREFERRED EMBODIMENT

Figure 1:
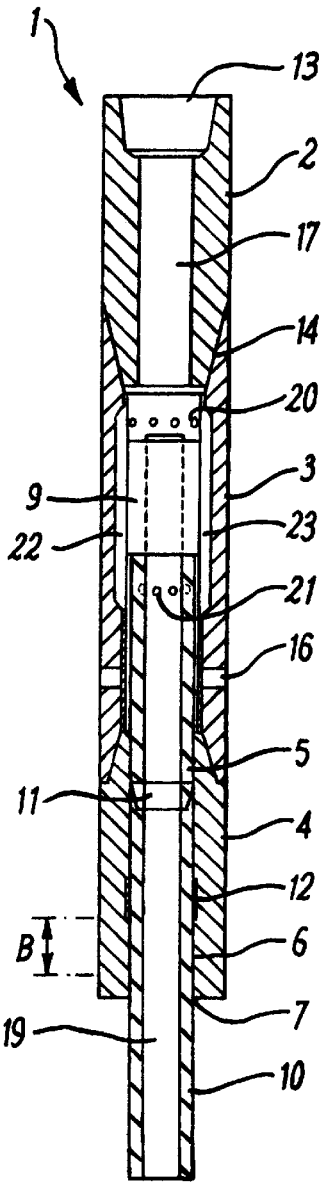
FIG. 1 illustrates the tool of the present invention in its fully collapsed position.

Referring to the Figures, a circulating tool is shown generally described at 1. The tool 1 includes a tubular assembly comprising a top sub 2, a main housing 3 and a bottom sub 4. Slidably mounted within the tubular assembly is an obturating member which comprises a seal piston 9 and a connected mandrel 10.

The top sub 2 includes an inlet 13 allowing for attachment to a drill string above the tool and a further connection at 14 for attachment to the main housing 3. The main housing 3 is joined to the bottom sub 4 and includes a number of generally transverse outlet ports 16 which extend from an axial through bore 17 which terminates at a generally axial outlet 7. In this specification, the outlet 7 shall also be described as the first outlet, while the outlets 16 shall also be described at the second outlet.

The obturating member is also provided with a through bore referenced 19 in the drawings.

The mandrel 10 includes a mating portion 5 comprised of a cornered, and in particular, hexagonal profile. The mating portion 5 on the mandrel 10 corresponds to a similarly shaped mating portion 6 located along the length referenced B on the inside of the bottom sub 4. Below the mating portion 5 on the mandrel 10 and above the mating portion 6 on the bottom sub 4 is provided a guide means 11, 12 in the form of shaped profiles which interact to guide, rotatably, the respective mating portions 5, 6 into mutual engagement.

At the lower end of the mandrel 10 (not shown) means is provided for connecting a drill string below the tool 1.

In FIG. 1 the tool 1 is in its fully collapsed position whereat the mating portions 5, 6 are disengaged and the piston member 9 is positioned between the ports 20 and 21 on the by-pass sleeve 22. This allows fluid to travel down the axial bore 17 and out the ports 20, down the by-pass channel 23 and back into the bore 17 via the ports 21. The fluid may then continue downwardly, travelling in the space between the inside of the by-pass sleeve 22 and the exterior of the hexagonal mandrel 10, thereby allowing for fluid flow out of the second outlet 16. Collapsing of the tool 1 occurs by causing part of the drill string communicating with the piston seal 9 to rest on a formation (not shown) in the borehole.

Figure 2:
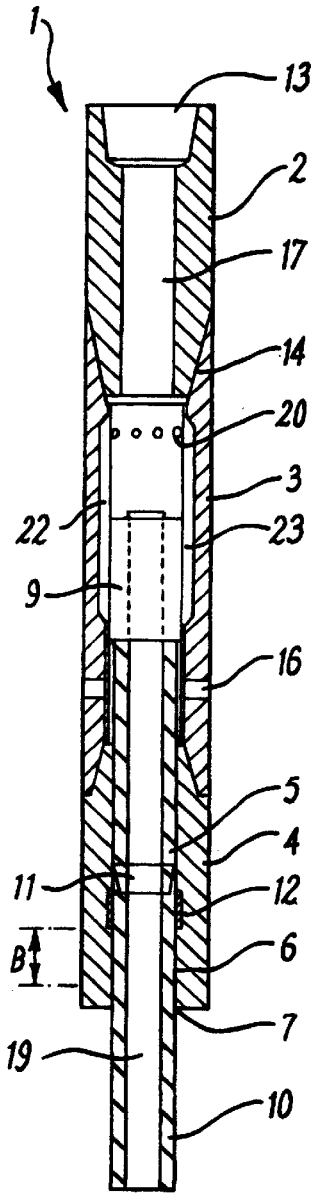
FIG. 2 illustrates the tool of the present invention in its partially extended position.

In FIG. 2 the tool 1 is in a partially extended position whereat the mating portions 5,6 are still disengaged but the piston member 9 covers the ports 21 and or the outlet ports 16 preventing fluid flow out of the second outlet 16.

Figure 3:
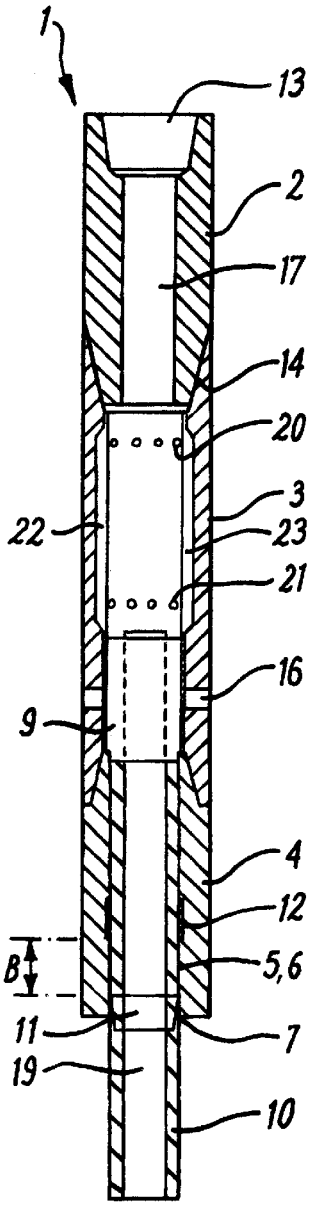
FIG. 3 illustrates the tool of the present invention in its fully extended position.

In FIG. 3 the tool 1 is in a fully extended position whereat the mating portions 5,6 are mutually engaged and the piston member 9 covers the outlet ports 16 preventing fluid flow out of the second outlet 16. Accordingly, fluid entering the tool 1 at the inlet 13 travels down the throughbore 17 and then enters the throughbore 19 which has an inlet at the top of the piston 9 and continues downwardly throughout the obturating member in the mandrel 10. Engagement of the mating portions 5,6 is assisted by the interaction of the guide means 11, 12 as the mandrel 10 travels downwardly relative to the tubular assembly and enables torque applied to the tubular assembly to be transmitted to the mandrel 10 and further down the drill string.

Figure 4C:
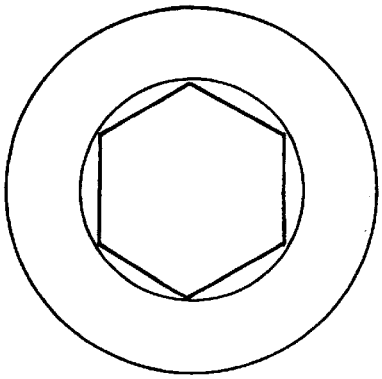
FIGS. 4A, 4B and 4C illustrate the detail of the lower sub for the present invention, FIG. 4A being section taken along line 4A—4A of FIG. 4B, and FIG. 4C being an end view of outlet 7 of the tool of the present invention.
Figure 4B:
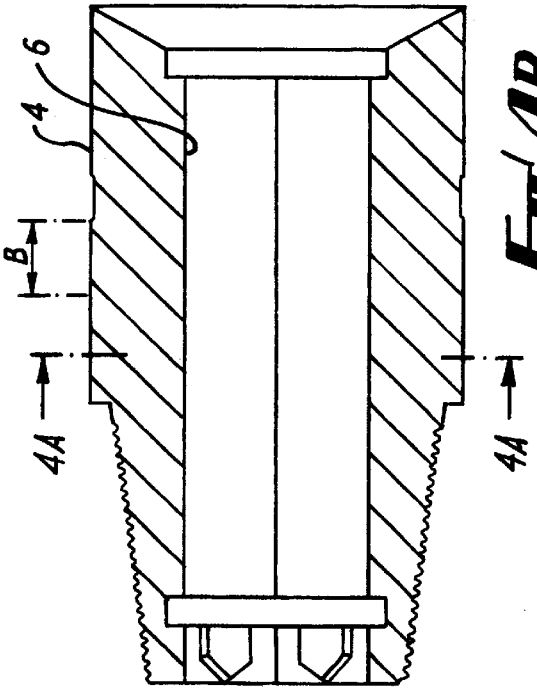
Figure 4A:
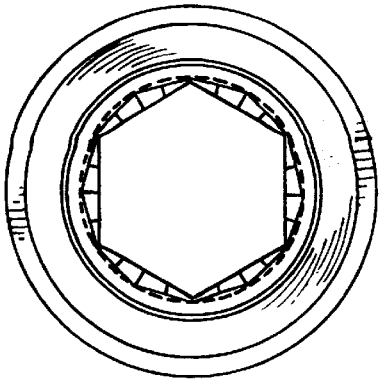
Figure 5:
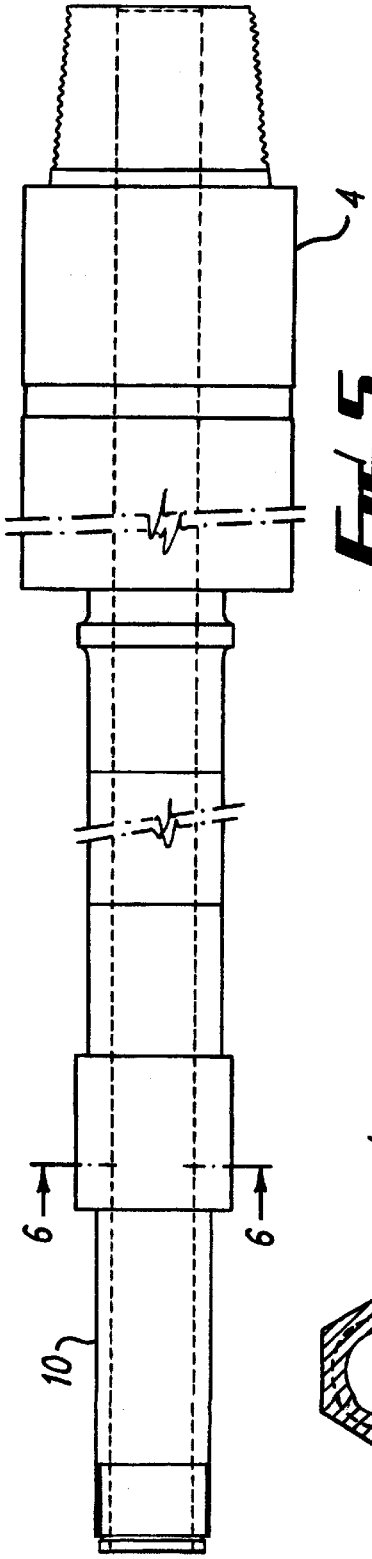
FIG. 5 illustrates a portion of the mandrel of the tool of the present invention.
Figure 6:
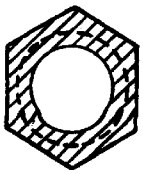
FIG. 6 is a section taken along line 6—6 of FIG. 5.

FIG. 4 is a detail of the lower sub 4, the guide means 12 being illustrated in FIG. 4A, which is the section taken along line 4A—4A of FIG. 4B, while the outlet 7 is shown in more detail in FIG. 4C. FIG. 5 illustrates a section of the mandrel, including that which engages with the hexagonal cross-section of the bore through the lower sub 4.

Thus the Figures illustrate three distinct stages in the extension or stroke of the tool 1. In a possible embodiment the stroke might equal fifteen inches with a obturating member and particularly the piston seal 9 blocking the second outlet 16 after only ten inches of the full stroke or extension.

Furthermore and importantly, the Figures illustrate how the tool 1 enables circulation down through the first outlet 7 and further axial outlets in the drill string, even in the event that the mating portions 5,6 fail to mutually engage. In the past, when the obturating member and the tubular assembly failed to engage, the second outlet has remained open, preventing the further use of the drilling apparatus in the bore hole. With the present invention, in the event that the engagement fails to occur, the only loss in utility is the inability to transmit torque beyond the tubular assembly, axial circulation still being possible.

The present invention also comprises the further advantage of mitigating the likelihood of the tool 1 failing to re-engage by providing a guide means 11, 12 which guides the respective mating portions 5, 6 into an appropriate alignment so as to facilitate the desired meshing or engagement.

Further modifications and improvements may be incorporated, without departing from the scope of the invention herein intended.

What is claimed is:

1. A circulation tool for circulating fluid in a borehole comprising a tubular assembly having an axial through passage between an inlet and a first outlet, a second outlet extending generally transversely of the tubular assembly, and an obturating member moveable relative to the tubular assembly between a first position closing the second outlet and a second position at which the second outlet is open, wherein the obturating member is also moveable between an engaging position at which it is engaged with the tubular assembly and a non-engaging position at which it is not so engaged with the tubular assembly, and wherein when the obturating member is in the said first position it may be in either the said engaging position or the said non-engaging position, wherein when the obturating member is in the engaging position torque imparted to the tubular assembly is transmitted to the obturating member and when the obturating member is in the non-engaging position torque imparted to the tubular assembly it not transmitted to the obturating member.

2. A circulation tool as claimed in claim 1, wherein the obturating member comprises a piston and a mandrel and is provided with a mating portion which engages when the obturating member is in the engaging position with a corresponding mating portion provided on the tubular assembly.

3. A circulation tool as claimed in claim 2, wherein the obturating member has a cornered profile at its mating portion corresponding to a similar shaped mating portion on the tubular assembly, one mating portion being male and the other female.

4. A circulation tool as claimed in claim 1, wherein guide means is provided for guiding the respective mating portions into an engaged relationship as the obturating member moves toward the said engaging position.

5. A circulation tool as claimed in claim 4, wherein the guide means comprises a shaped profile on the obturating member and the tubular assembly which interact to align the respective mating portions as the obturating member moves toward the said engaging position.

6. A method of cleaning a borehole comprising the steps of:

a) connecting a circulation tool in a drill string suspended in the borehole, the circulation tool having a tubular assembly and an obturating member axially movable relative thereto by a predetermined distance or stroke, the tubular assembly also having one or more generally transverse fluid outlets which allows fluid flow therethrough when the one or more generally transverse outlets are open;

b) causing sufficient movement of the obturating member to close or obstruct the transverse one or more fluid outlets, wherein the said sufficient movement is less than the said predetermined distance or stroke; and c) allowing additional movement of the obturating member relative to the tubular assembly to cause engagement of a mating portion on the obturating member with a corresponding mating portion on the tubular assembly.

7. A method as claimed in claim 6, wherein the first of the said steps, some or all of the weight of the drill string is supported on a formation in the borehole, and in the second and third of the said steps the weight or a percentage thereof of the drill string is picked up.

8. A method as claimed in claim 6 or claim 7, whereby rotational guidance is provided during the said additional movement to guide the corresponding mating portions into mutual engagement.

* * * * *